US008915828B1

(12) United States Patent
Stalnaker et al.

(10) Patent No.: US 8,915,828 B1
(45) Date of Patent: Dec. 23, 2014

(54) ERGONOMIC ROTATIONAL MUSCLE STRETCHING DEVICE AND METHOD

(71) Applicants: Donald Stalnaker, Uniontown, PA (US); Steve McIntyre, Uniontown, PA (US)

(72) Inventors: Donald Stalnaker, Uniontown, PA (US); Steve McIntyre, Uniontown, PA (US)

( * ) Notice: Subject to any disclaimer, the term of this patent is extended or adjusted under 35 U.S.C. 154(b) by 0 days.

(21) Appl. No.: 14/254,698

(22) Filed: Apr. 16, 2014

(51) Int. Cl.

| | |
|---|---|
| ***A63B 21/015*** | (2006.01) |
| ***A63B 21/00*** | (2006.01) |
| ***A63B 23/035*** | (2006.01) |
| *A63B 23/00* | (2006.01) |

(52) U.S. Cl.
CPC ..... *A63B 23/035* (2013.01); *A63B 2023/006* (2013.01)
USPC ..... 482/131; 482/117

(58) Field of Classification Search
USPC ..... 482/44–50, 79–82, 92–93, 106–108, 482/114–115, 117, 131–132, 139
See application file for complete search history.

(56) References Cited

U.S. PATENT DOCUMENTS

| | | | | |
|---|---|---|---|---|
| 3,215,429 | A * | 11/1965 | Shaboo et al. | 482/125 |
| 4,822,035 | A * | 4/1989 | Jennings et al. | 482/106 |
| 5,022,648 | A * | 6/1991 | Travis | 482/126 |
| 6,682,464 | B2 * | 1/2004 | Shifferaw | 482/106 |
| 6,692,416 | B1 * | 2/2004 | Davis | 482/139 |
| 7,614,984 | B1 * | 11/2009 | Krull | 482/131 |
| 8,075,455 | B2 * | 12/2011 | Gamboa et al. | 482/82 |

* cited by examiner

*Primary Examiner* — Loan H Thanh
*Assistant Examiner* — Jennifer M Deichl
(74) *Attorney, Agent, or Firm* — Acker Wood IP Law, LLC; Gwen R. Acker Wood

(57) ABSTRACT

The present invention provides an ergonomic, rotational muscle stretching device and method for use by an individual to rehabilitate one or more muscles groups after injury or surgery, or for use by an individual for general muscle exercise purposes. The device and method allow for stretching, strengthening, and increasing flexibility of the one or more muscle groups while placing minimal stress and/or strain on associated joints due to the ability of the device to ergonomically rotate along x, y and z axes in tandem with the joints associated with the muscles being exercised, i.e., the device effectively mimics motion of the joints. This allows joints to move freely through their full range of motion so that a complete, symmetrical stretch of the exercised muscles is achieved without placing negative stress and/or strain on the joints.

20 Claims, 13 Drawing Sheets

ERGONOMIC ROTATIONAL MUSCLE STRETCHING DEVICE AND METHOD

FIELD OF THE INVENTION

The present invention relates to exercise devices and, more particularly, to an ergonomic, rotational, muscle stretching device to exercise healthy muscles, or to rehabilitate muscles after injury or surgery, without placing negative stress and/or strain on associated joints of the muscles.

BACKGROUND OF THE INVENTION

After injury or surgery, physical therapy, or rehabilitation of the affected musculature is important to a patient's recovery. Rehabilitation includes an exercise conditioning program which facilitates the patient's return to daily activities and enjoyment of a more active, healthy lifestyle.

Rehabilitation of specific muscle groups includes stretching, strengthening and increasing flexibility of the affected musculature, which is important for restoring normal range of motion and preventing further injury. This also helps to keep the musculature long and flexible and to reduce muscle soreness.

For example, shoulder injury, which involves the rotator cuff (a group of muscles and tendons which surround the shoulder joint), occurs most often in people who perform repetitive overhead motions in their jobs or in sports. This type of injury also increases with age. Current exercise programs to rehabilitate these injuries typically involve holding a straight rod or wand in one's hands and moving the rod or wand in various directions to strengthen the front and back regions of the shoulder joint. A big disadvantage of using such devices for physical therapy of injured muscle tissue is the stress and/or strain placed on associated joints of the exercised muscles, such as the wrists, elbows and rotator cuff joints, due to the rigidity of the rod or wand, and thus its inability to allow for natural motion of the joints. This, in turn, reduces the ability to fully and satisfactorily stretch the muscles and underlying tendons and ligaments, resulting in a less than optimal exercise routine for injured, as well as healthy muscles.

There exists a need, therefore, for a muscle stretching device that is rotational and ergonomic, while being portable, which can move in tandem with, i.e. mimic, the rotational motion of joints associated with exercising muscles, so that a full stretch of the muscles and underlying tendons and ligaments can be achieved during an exercise program without the associated negative stress and/or strain on joints which typically is encountered when exercising with prior art exercise devices.

SUMMARY OF THE INVENTION

The present invention fulfills this need by providing a portable, ergonomic, rotational muscle stretching device which allows the user to stretch, strengthen, and increase flexibility of healthy muscles, or muscles after having undergone an injury or surgery, without placing potentially harmful stress and/or strain on the corresponding joints of the muscles.

In an aspect of the invention, there is provided an ergonomic rotational muscle stretching device comprised of a center rod having a first end, a second end, and an interior opening therein, said interior opening having threads therein; and a first handle and a second handle, each of said first and second handles having a first end, a second end, each of the first and seconds ends having an interior opening therein, the openings having threads therein; and a first linear bearing and a second linear bearing, each of the first and second linear bearings having a socket end and a ball end, the socket end having a first side and a second side, the ball end having a first side and a second side, the first side of the socket end having an opening therein which accepts the second side of the ball end inserted therein, the second side of the socket end comprised of a socket end bolt, the first side of the ball end comprised of a ball end bolt. The first socket end bolt threadably inserts into the interior opening of the first end of the center rod, and the second socket end bolt threadably inserts into the interior opening of second end of the center rod. The first ball end bolt threadably inserts into the interior opening of the first end of the first handle, and the second ball end bolt threadably inserts into the interior opening of the first end of the second handle.

The first and second linear bearings allow for rotational movement of the first and second handles ranging from about 10 degrees to about 75 degrees on an x and y axis, and for a 360 degree rotation on a z axis.

The center rod may have an adjustable length, comprised of a first rod section and a second rod section, in which the first rod section has a larger inner diameter than an outer diameter of the second rod section, so that that the second rod section can insert telescopically into the interior opening of the first rod section. The adjustable length of the center rod can range from about 5.0 inches to about 30 inches. After the center rod is adjusted to a desirable length, the two center rod sections are locked in place with a locking ring.

In accordance with the invention, one or more weights, such as hinged weights having a clasp for securing the weight on the device, or bar weights screwed into the device, may be placed on the center rod of the device to increase the load applied to exercising muscles.

In accordance with the invention, a first stirrup may be attached to the first handle, and a second stirrup may be attached to the second handle. Each of the stirrups is attached via bolts which insert into the openings of the second ends of the first and second handles.

In another aspect of the invention, there is provided a method of stretching and strengthening one or more muscles groups of an individual. The method comprises providing an individual with the ergonomic rotational muscle stretching device described above in order to stretch, strengthen and increase flexibility to one or more muscle groups of the individual.

The method further comprises having an individual grip the first handle of the device with one hand, and grip the second handle of the device with another hand; and stretching one or more muscle groups by pushing and/or pulling on the handles, said handles rotating on the x, y and z axes in tandem with rotation of joints associated with the one or more muscle groups so that the joints are not unduly stressed and/or strained during the stretching of the one or more muscle groups.

The method further comprises attaching a first stirrup having a bolt attached thereon onto the second end of the first handle, said first stirrup attached by threadably inserting the bolt into the opening of the second end of the first handle; attaching a second stirrup having a bolt attached thereon onto the second end of the second handle, said second stirrup attached by threadably inserting the bolt into the opening of the second end of the first handle; having an individual place one foot in the first stirrup and the other foot in the second stirrup; and stretching one or more muscle groups by pushing and/or pulling on the handles, said handles rotating on the x, y and z axes in tandem with rotation of joints associated with the one or more muscle groups so that the joints are not unduly stressed and/or strained during the stretching of the one or more muscle groups.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

The present invention provides a portable, ergonomic rotational muscle stretching device which is particularly suited for patients requiring rehabilitative exercise therapy after muscle injury or surgery, but may be used by healthy individuals for general muscle exercise purposes. The device allows a user to stretch, strengthen and increase flexibility of one or more muscle groups without negatively stressing and/or straining joints associated with the one or more muscle groups. When used for rehabilitation, the exercise device of the invention facilitates recovery from injury or surgery. As will be described in detail herein, the device is able to ergonomically move in tandem with the motion of joints associated with muscles being exercised, i.e., the device effectively mimics the motion of the joints, due to the ability of the device to rotate along the x, y and z axes, which allows the joints to move freely through their full range of motion, which allows for a complete and symmetrical stretch of the exercising muscles without placing negative stress and/or strain on associated joints of the muscles.

As used herein, the term "ergonomic" is defined as the design and arrangement of a device so that a user of the device and the device interact efficiently and safely in order to maximize productive use of the object and to minimize discomfort and fatigue of, and risk of injury to, the user.

As used herein, the phrase "in tandem" is defined as two entities (persons and/or objects) that are functionally associated with each other and work together with respect to their respective movements or motions in order to efficiently and effectively facilitate their respective movements or motions.

As used herein, the phrases "linear bearing," linear bearing joint," and "joint" are meant to be interchangeable.

As used herein, the terms "negative" and "negatively" are meant to be interchangeable with the terms "harm" and "harmful."

As used herein, the terms "rotation" and "rotational" are defined as movements or motions occurring on the x, y and z axes.

As used herein, the phrase "symmetrical joint motion" is meant to refer to a substantially identical degree of motion of bilateral joints when corresponding muscles of the joints are being exercised at the same time.

Figure 1:
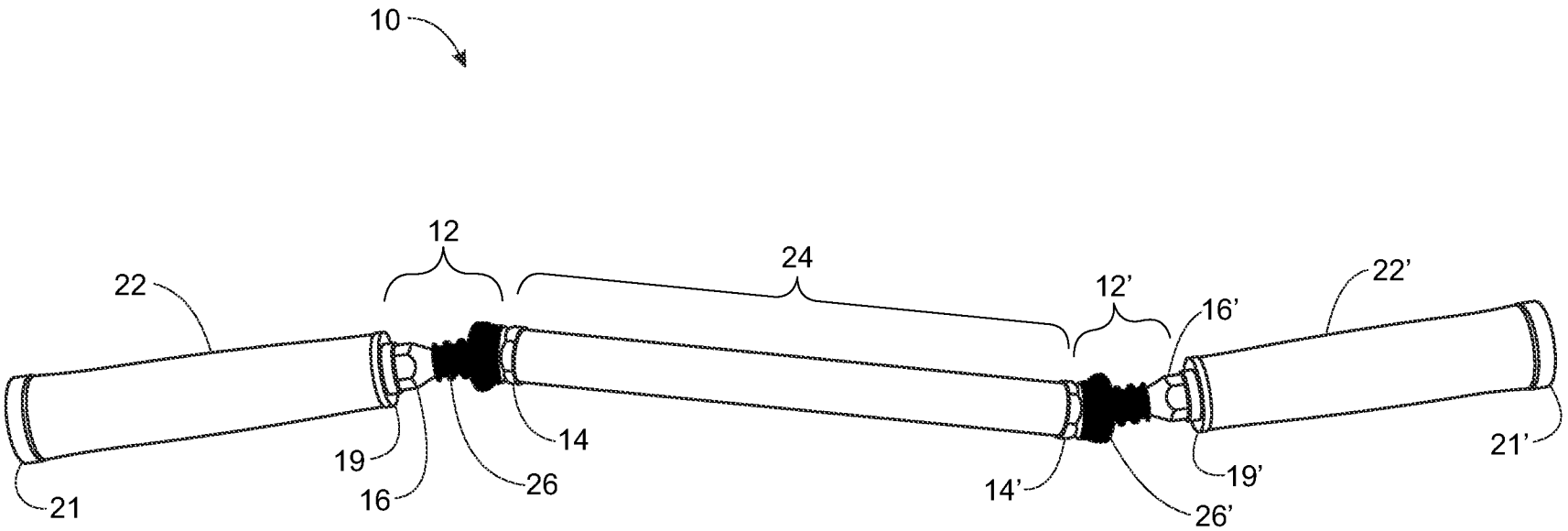
FIG. 1 shows the ergonomic rotational muscle stretching device having a protective covering over the linear bearings, in accordance with the embodiments of the invention.

Referring now to FIGS. 1-4, the ergonomic rotational stretching device 10 in accordance with the invention includes a center rod 24 having a first end 23, a second end 25, and an interior opening therein which contains threads to accept a threaded bolt (not shown); and a first handle 22 and a second handle 22', each having a first end 19, 19; and a second end 21, 21', the first and second ends 21, 21' each having a first interior opening (not shown) and a second interior opening 51 therein, respectively (shown in FIG. 4). The first handle 12 is connected to the first end 23 of the center rod 24 and a second handle 22' is connected to the second end 25 of the center rod 24. The means by which the first and second handles 22, 22' are connected to the center rod 24 is via a linear bearing joint 12, 12'. The linear bearing joint is comprised of a first linear bearing 12 which attaches the first handle 22 to the first end 23 of the center rod 24, and a second linear bearing 12' which attaches the second handle 22' to the second end 25 of the center rod 24 (shown in FIG. 2). In an embodiment, a flexible covering 26, shown in FIGS. 1 and 4, is placed over the first and second linear bearings 12, 12' to protect the linear bearings from wear and tear. The flexible covering 26 can be made from materials which include, without limitation, rubber or plastics. The linear bearing joints 12, 12' of the device 10, described in detail below, allow for the three-dimensional rotational movement of the two handles 22, 22' on the x, y and z axes.

Figure 2:
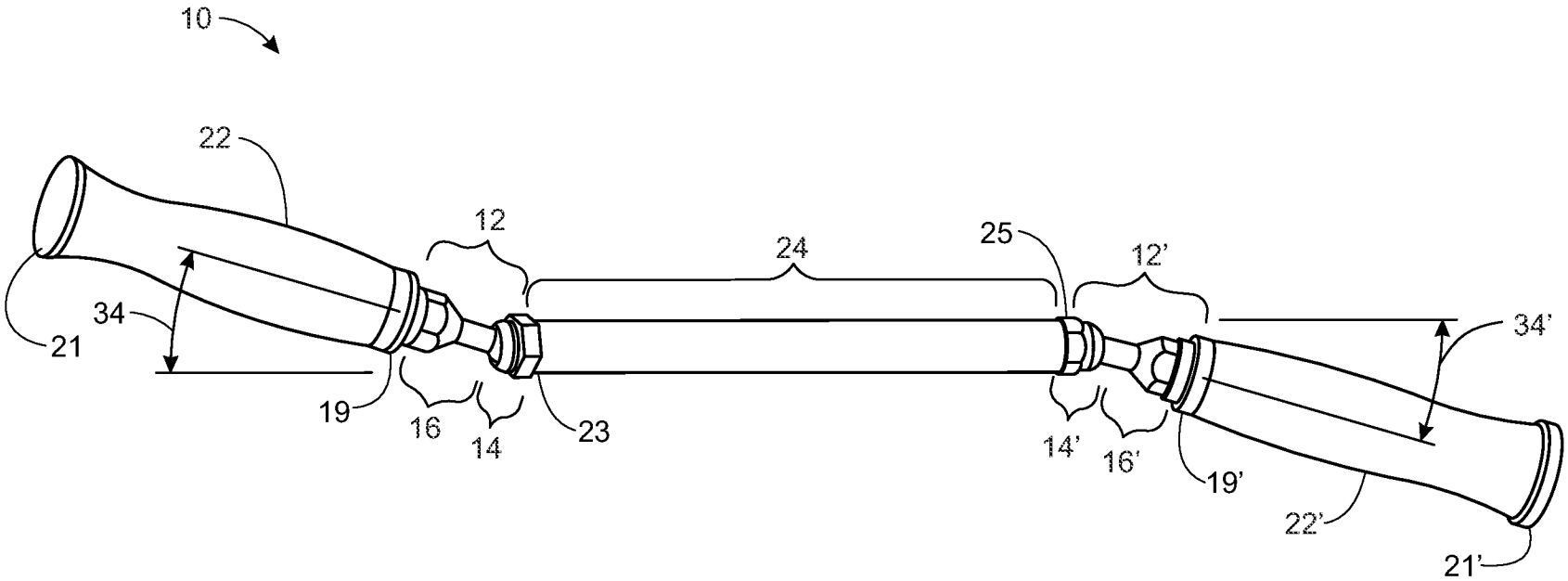
FIG. 2 shows the ergonomic rotational muscle stretching device with the linear bearings exposed and both handles rotated at an angle, in accordance with the embodiments of the invention.
Figure 3:
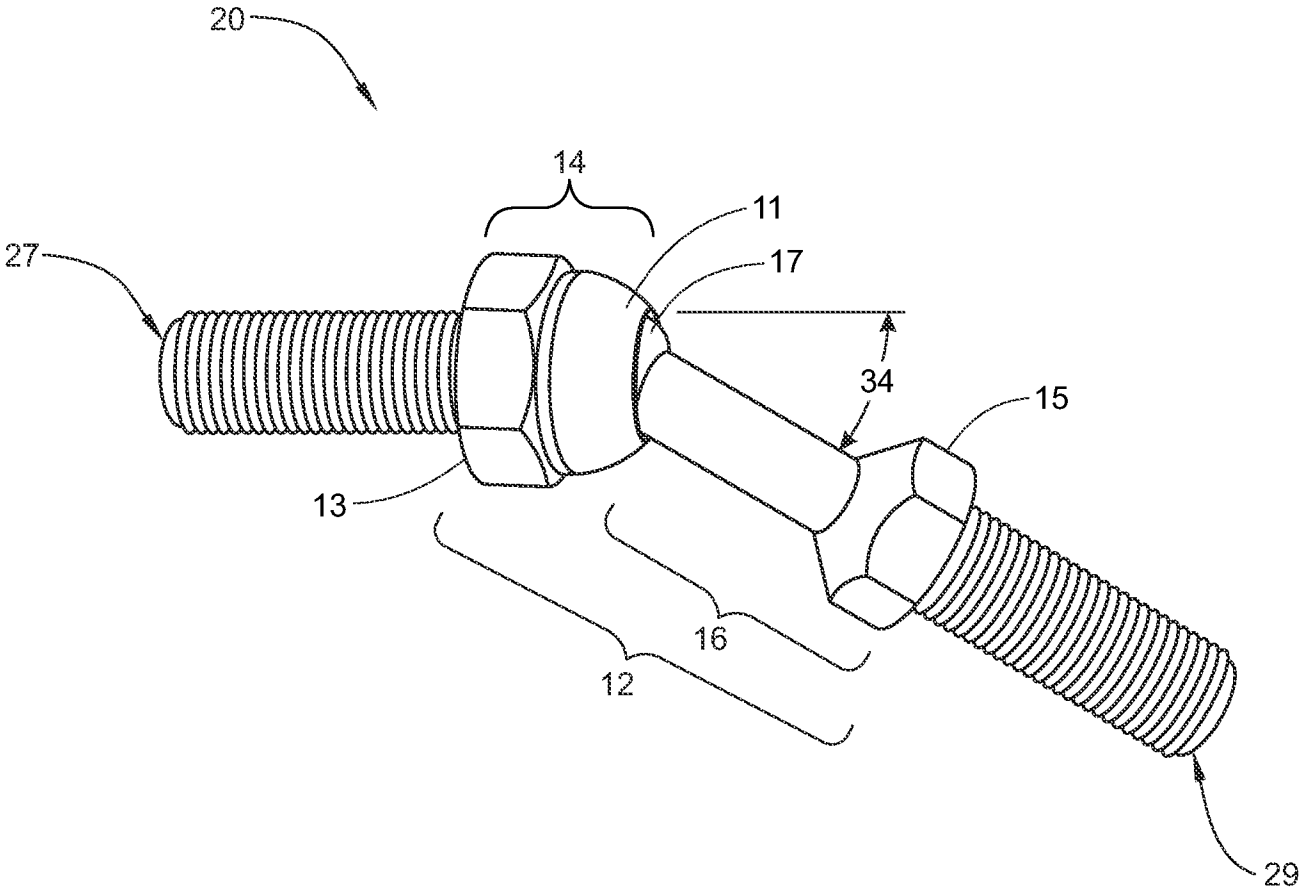
FIG. 3 shows one linear bearing, also referred to as a linear bearing joint, of the ergonomic rotational muscle stretching device, in accordance with the embodiments of the invention.

FIG. 3 shows one linear bearing joint with attached bolts 20, which includes a socket end 14 and a ball end 16. The socket end 14 has a first side 11 and a second side 13, and the ball end 16 has a first side 15 and a second side 17. The first side 11 of the socket end 14 has an opening therein to which the second side 17 of the ball end 16 is inserted therein. The second side 13 of the socket end 14 is securely attached to a socket end bolt 27, and the first side 15 of the ball end 16 is securely attached to a ball end bolt 29. Referring now to FIG. 2, the socket end bolt 27 (not shown) of the first socket end linear bearing 14 threadably inserts into the interior opening of the first end 23 of the center rod 24, and the socket end bolt 27 (not shown) of the second socket end 14' threadably inserts into the interior opening of second end 25 of the center rod 24. The ball end bolt 29 threadably inserts into the interior opening of the first end 19 of the first handle 22, and the ball end bolt 29 threadably inserts into the interior opening of the first end 19 of the second handle 22'.

Figure 4A:
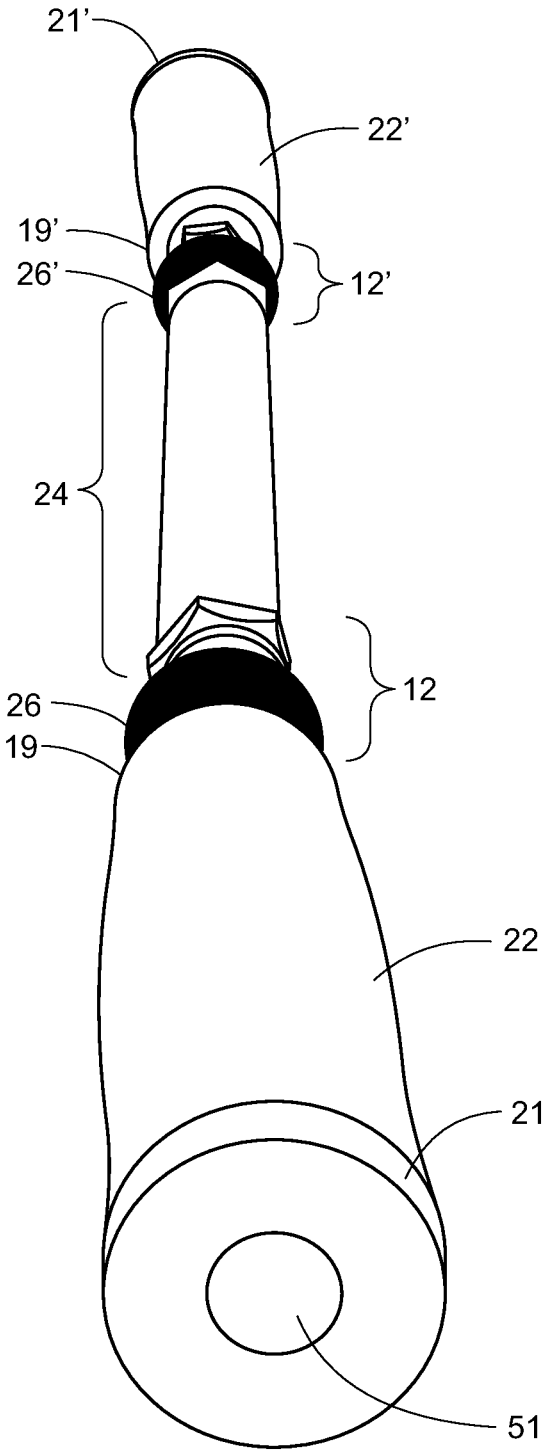
FIG. 4 shows the ergonomic rotational muscle stretching device, in which (A) both handles are unrotated; (B) the handle rotation along the x-axis; (C) the handle rotation along the Y-axis; and (D) one handle rotated 360 degrees along the z-axis, according to the embodiments of the invention.
Figure 4B:
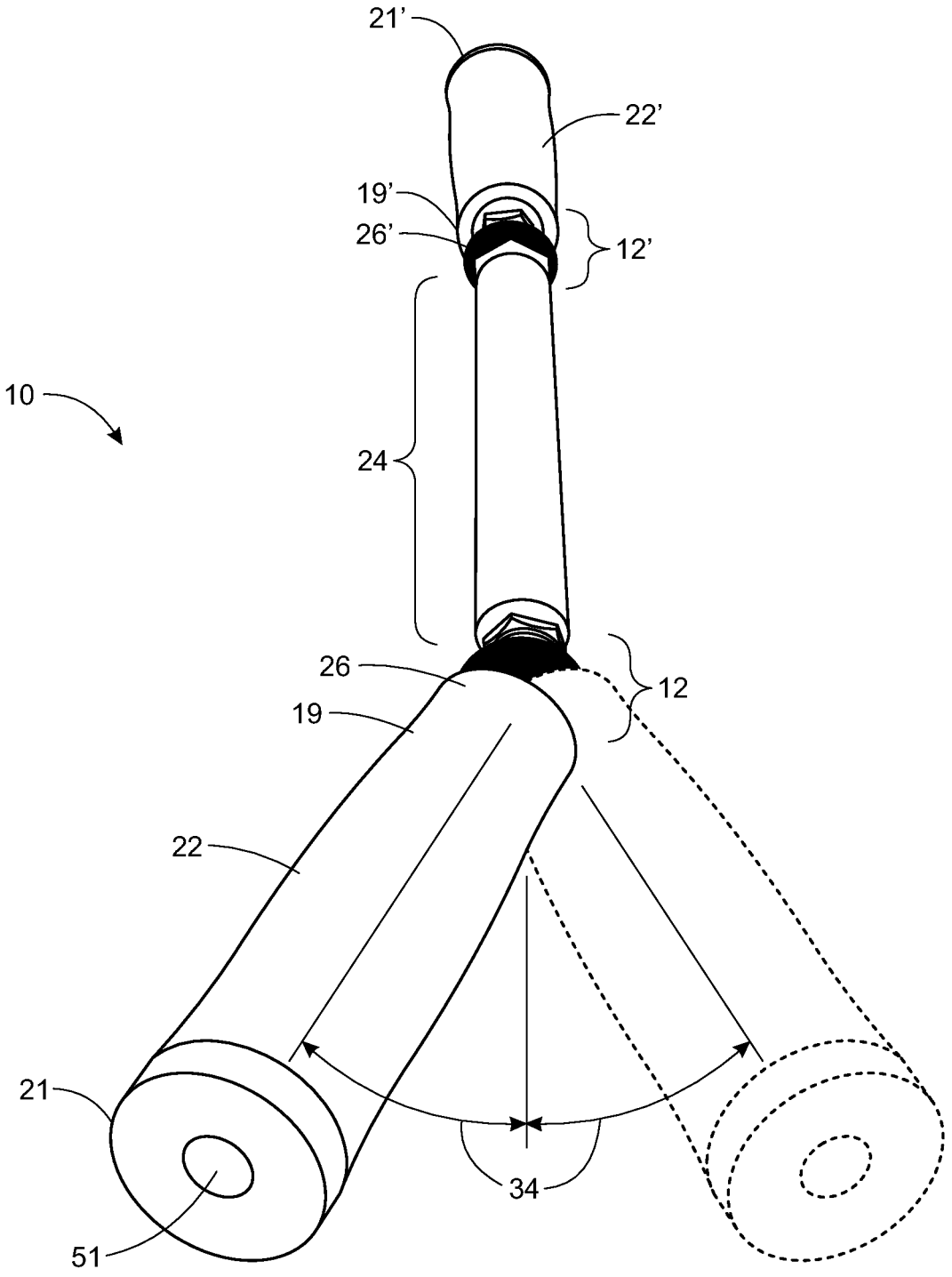
Figure 4C:
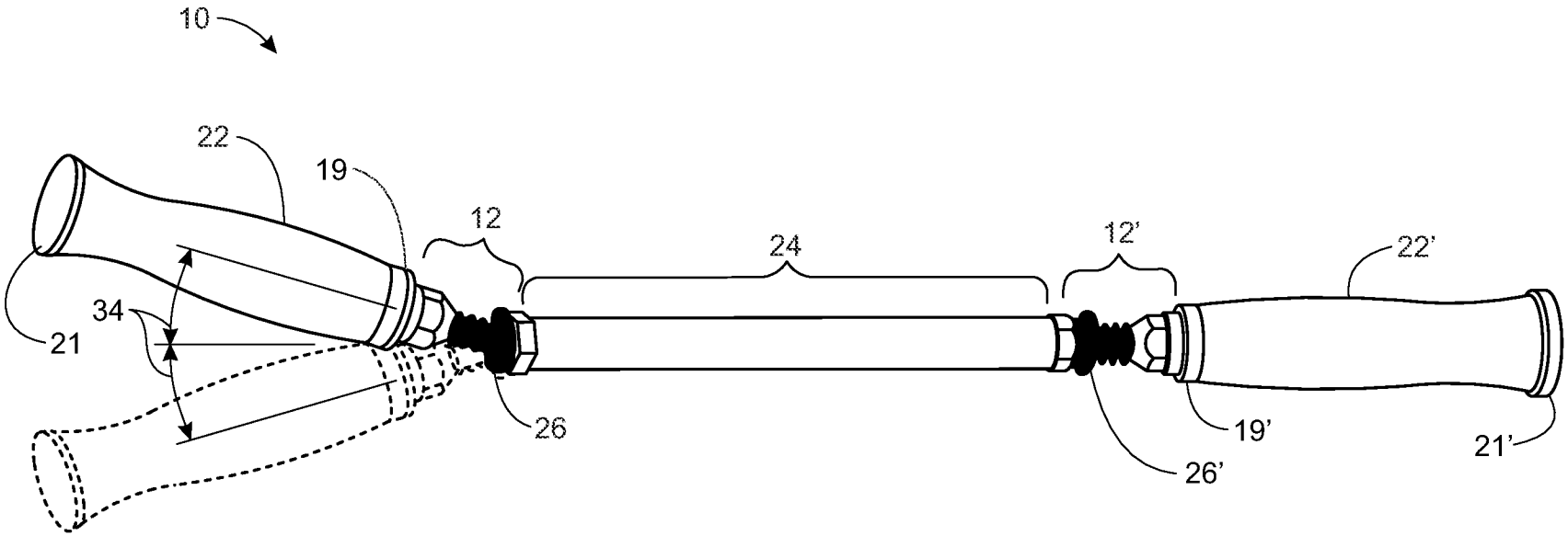
Figure 4D:
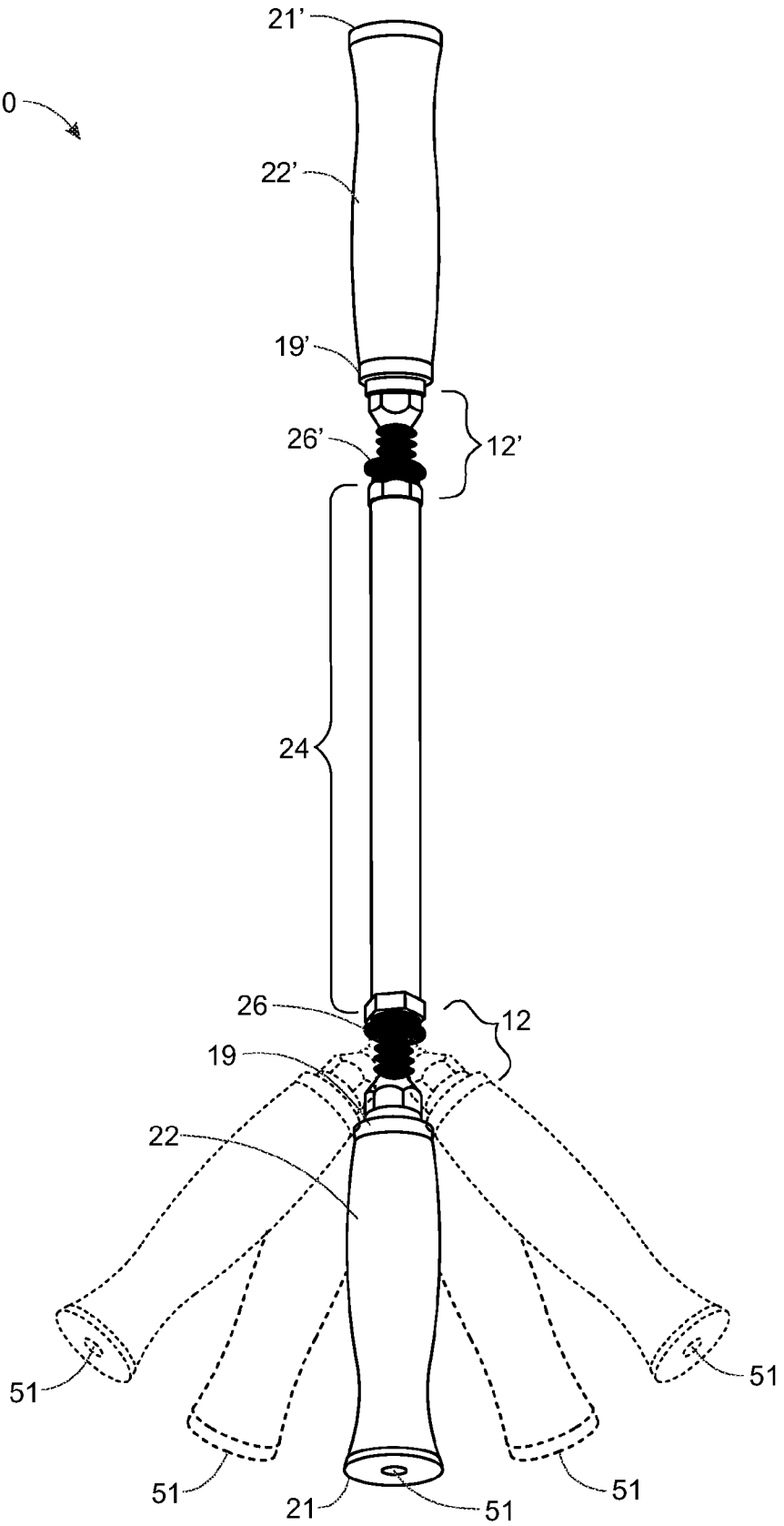

In accordance with the invention, the ball ends 16, 16' thus inserted into the socket ends 14, 14' of the linear bearings 12, 12' are able to freely rotate within the opening of the socket ends 14, 14' on the x, y, and z axes, which, in turn, allows for rotation on the x, y, and z axes of the first and second handles 22, 22'. In an embodiment, the first and second linear bearings 12, 12' allow the first and second handles 22, 22' to rotate between about 10 degrees to about 75 degrees on the x and y axes, and to rotate 360 degrees on a z axis. In another embodiment, the first and second handles 22, 22' are able to rotate about 30 degrees on the x and y axes (FIG. 4B,C) and to rotate 360 degrees on the z axis (FIG. 4D). FIG. 4A shows the device 10 with the first and second handles 12, 12' unrotated.

In accordance with the invention, the length of the center rod ranges from about 5 inches to about 30 inches, the outer diameter of the center rod ranges from about 0.25 inches to about 3.0 inches, and the inner diameter of the opening of the center rod ranges from about 0.15 inches to about 2.0 inches. In an embodiment, the length of the center rod is about 25 inches, the outer diameter of the center rod is about 0.5 inches, and the inner diameter of the opening of the center rod is about 0.3 inches.

In accordance with the invention, the first handle and the second handle have a length that ranges from about 3.0 inches to about 6.0 inches, an outer diameter that ranges from about 0.5 inches to about 3.0 inches, and an inner diameter of the interior opening of the handle that ranges from about 0.25 inches to about 1.5 inches. In an embodiment, the first and second handles have a length of about 4.5 inches, an outer diameter of about 1.0 inch, and an inner diameter of the interior opening of about 0.5 inches.

Figure 5:
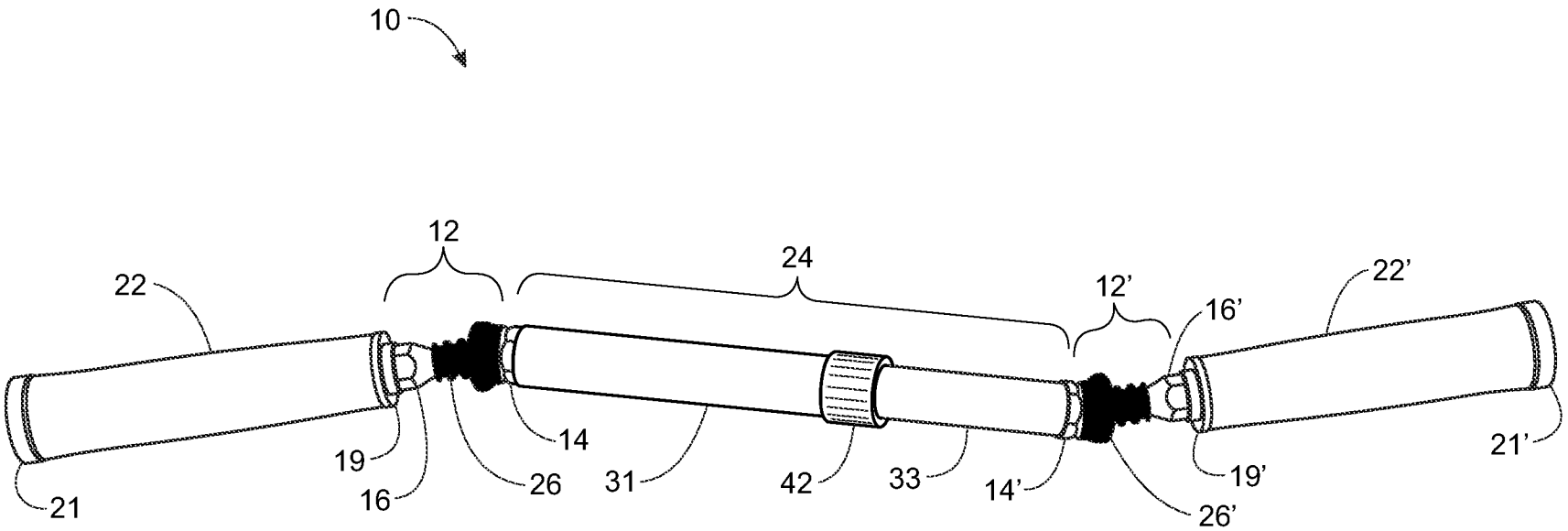
FIG. 5 shows the ergonomic rotational muscle stretching device comprising two center rod sections which telescopically insert into one another and locked in place with a locking device.

In another embodiment, as shown in FIG. 5, the center rod 24 of the device 10 can be adjustable in length. When adjustable, the center rod 24 is comprised of a first center rod section 31 and a second center rod section 33. The first rod section 31 has a slightly larger inner diameter than the outer diameter of the second rod section 33. This allows the second rod section 33 to insert telescopically into the interior opening of the first rod section 31. The two center rod sections 31, 33 are locked in place with a locking ring 42, which secures the two center rod sections 31, 33 together. Any suitable locking ring commonly known and used to secure two telescopically connected elongated sections together may be used in accordance with the invention. The adjustable length of the center rod can range from about 5.0 inches to about 30 inches. The inner diameter of the first rod section can range from about 0.25 inches to about 2.0 inches, and the outer diameter of the second rod section can range from about 0.20 inches to about 1.75 inches. In an embodiment, the inner diameter of the first rod section is about 0.5 inches and the outer diameter of the second rod section is about 0.3 inches.

Figure 6:
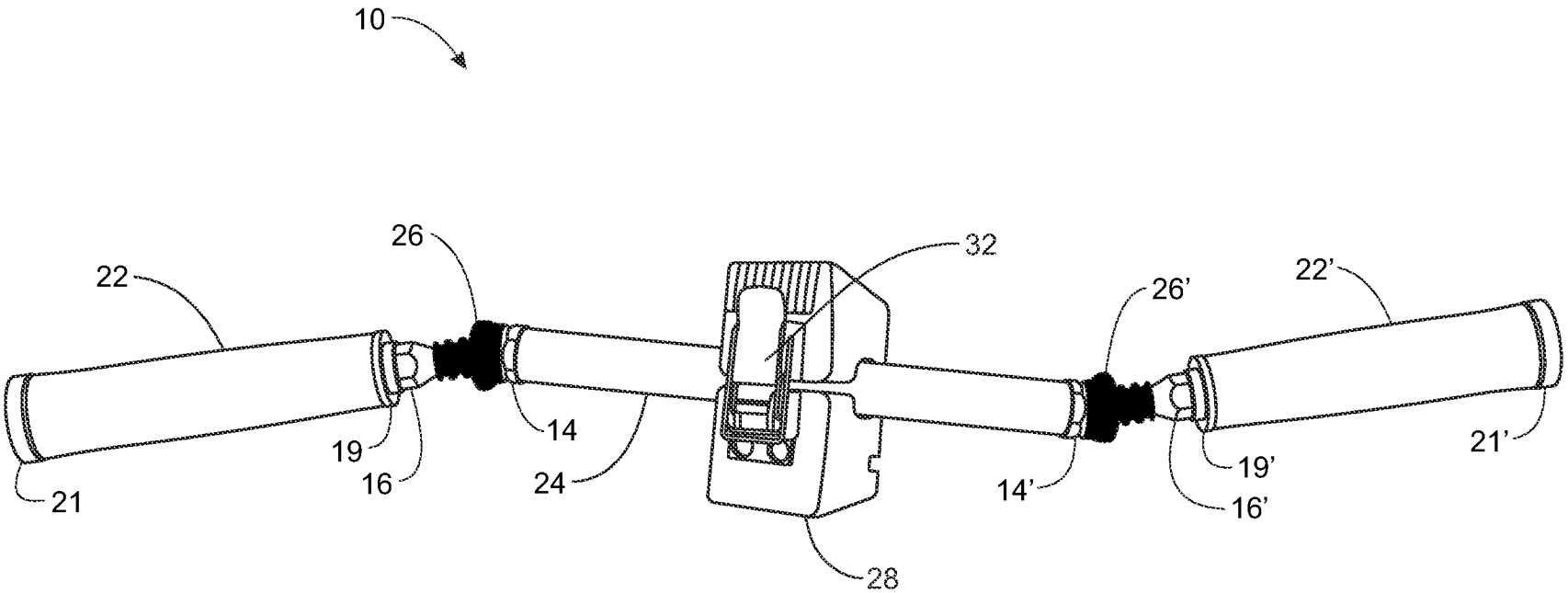
FIG. 6 shows the ergonomic rotational muscle stretching device having a hinged weight attached to the center rod portion via a clasp, in accordance with the embodiments of the invention.
Figure 7:
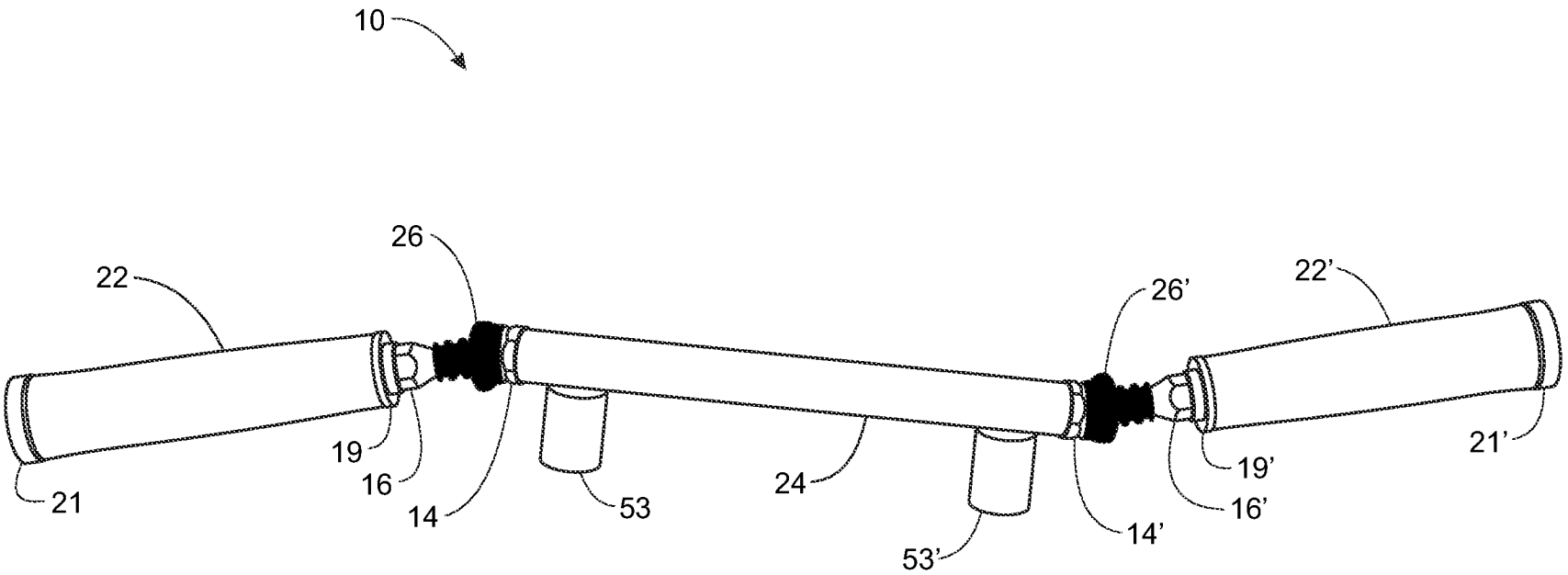
FIG. 7 shows the ergonomic rotational muscle stretching device having two bar weights which are threadably inserted into threaded holes placed in the first side and the second side of the center rod of the device, in accordance with the embodiments of the invention.

In accordance with the invention, one or more weights may be added onto the center rod of the device in order to increase the weight of the device, and thus the load applied to the one or more exercising muscles. In an embodiment, as shown in FIG. 6, the weight is comprised of a hinged weight 28 which attaches to the center rod 24 of the device 10, and locks in place via a clasp 32. Any suitable hinged weight having a locking clasp, and bar weight, known in the art may be used in accordance with the invention. In another embodiment, the weight is comprised of a bar weight having a threadable bolt contained therein and protruding from one end of the bar weight. The length of the screw can range from about 1.0 inch to about 4.0 inches long, and the diameter can range from about 0.5 to about 3.0 inches. In an embodiment, a bar weight weighs about 1.0 pound has a length of about 2.25 inches and a diameter of about 1.5 inches. FIG. 7 shows two bar weights 53, 53' located at the first end 23 and the second end 25 of the center rod section, and threadably inserted via their bolts into two holes having mating threads therein contained in the center rod section (not shown). Thus configured, the two weights 53, 54' provide an evenly balanced weight to the device 10. Alternatively, one weight may be added to the center rod section in the center of the rod for even balance, or at one end for an uneven balance if such uneven balance is desired (not shown). In an embodiment, the bar weights may be dipped in colored plastic coatings. The hinged weights and the bar weights can be made from materials which include, without limitation, metals such as aluminum, anodized aluminum, steel, chrome, brass or copper. In an embodiment, the hinged weights and the bar weights can range from about 0.5 pounds to about 5.0 pounds. In another embodiment, the hinged weights and the bar weights are about 1.0 pound.

The center rod may be manufactured from materials which include, without limitation, aluminum, anodized aluminum, steel, chrome, plastic, rubber, conduit, graphite, carbon fiber, fiberglass, brass, copper or wood. The first and second linear bearings may be manufactured from materials which include, without limitation, steel, brass or plastics. The first and second handles may be manufactured from materials which include, without limitation, rubber, leather, cork, cord or plastics.

The present invention also provides a method of stretching, strengthening and increasing flexibility of one or more muscles groups of an individual, comprising having an individual exercise one or more muscle groups with the ergonomic rotational muscle stretching device described above, wherein the device does not place negative stress and/or strain on joints associated with the one or more muscle groups.

In use, when exercising the upper body, the method comprises having an individual grip the first handle with one hand and grip the second handle with another hand, and stretching one or more muscle groups of the hands, arms, chest, back and/or shoulders by pushing and/or pulling on the handles, the handles rotating on the x, y and z axes in tandem with rotation of joints associated with the one or more muscle groups during the stretching of the one or more muscle groups so that the joints are not stressed. The degree of symmetrical joint motion when exercising with the device of the invention is substantially greater than the degree of symmetrical joint motion when performing the same exercise with prior art exercise devices.

Figure 8:
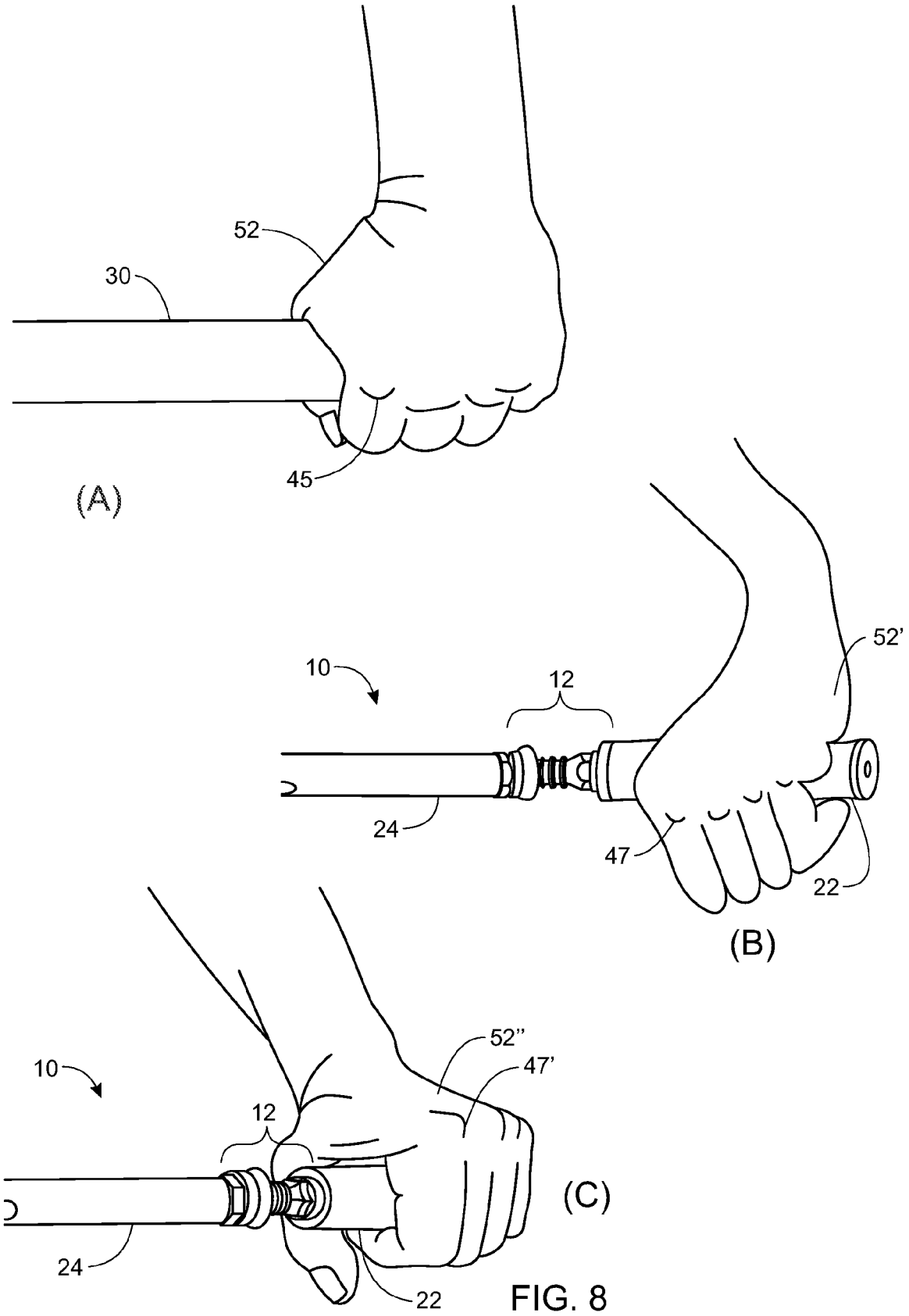
FIG. 8 shows left hand configurations when gripping: (A) a prior art exercise rod, in which minimal joint movement is accommodated during exercise; (B) the ergonomic rotational muscle stretching device, in which the handle is pushed forward and maximal joint movement of the left hand is achieved during exercise compared to the prior art device; and (C) the ergonomic rotational muscle stretching device, in which the handle is pulled backward and maximal joint movement of the left hand is achieved during exercise compared to the prior art device.

FIGS. 7-8 show the difference in rotation angles and hand orientations between stretching with a prior art stretching tool 30 with one's left hand 52 (FIG. 7A) and one's right hand 54 (FIG. 8A), compared to stretching with the inventive device 10 with one's left hand 52', 52" (FIG. 7B,C) and one's right hand 54', 54" (FIG. 8B,C). In particular, as shown in FIGS. 7A and 8A, when gripping a prior art stretching tool 30 with one's hand 52 during a stretch exercise, the prior art stretching tool 30 accommodates a negligible rotation angle 48 of the wrist joint during the stretch exercise, compared to the rotation angle 46 of the wrist joint when one's left hand 52', 52" and one's right hand 54', 54" are gripping the inventive device 10 during a stretch exercise. FIGS. 7B and 8B show the hands 52', 54' stretching the device forwardly to accommodate a wrist rotation angle 46 which is substantially greater than the negligible wrist rotation angle 48 possible when using the prior art stretching tool 30. This also is shown by the difference in orientation of the knuckles of the hands stretching with the prior art device and the invention device, in which the knuckles 45 of the left hand 52 and right hand 54 exercising with the prior art stretching tool 30 essentially face forwardly due to the inability of the wrist joint to rotate, compared to the orientation of the knuckles 49 of the left hand 52" and the right hand 54", which face leftwardly and rightwardly, respectively, when exercising with the inventive device 10 and pushing the handles 12, 12' in a forwardly direction (shown in FIGS. 7B and 8B); and face rightwardly and leftwardly, respectively, when exercising with the inventive device 10 and pulling the handles 12, 12' in a backwardly direction (shown in FIGS. 7C and 8C).

Figure 9:
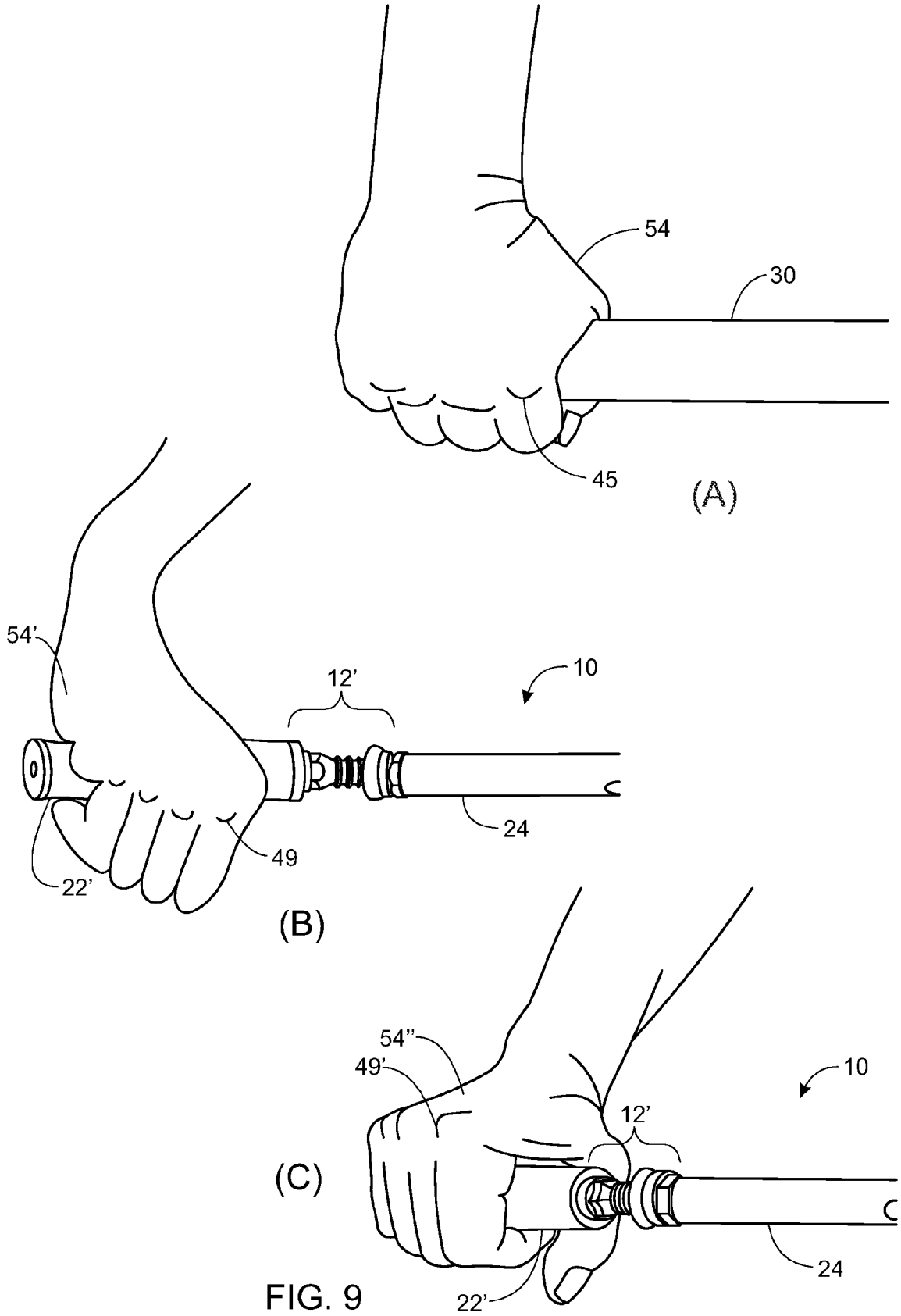
FIG. 9 shows right hand configurations when gripping: (A) a prior art exercise rod, in which minimal joint motion is accommodated using the prior art rod during exercise; (B) the ergonomic rotational muscle stretching device, in which the handle of the device is pushed forward and maximal joint motion of the right hand is allowed during exercise compared with the prior art device; and (C) the ergonomic rotational muscle stretching device, in which the handle is pulled backward and maximal joint motion of the right hand is allowed during exercise compared with the prior art device.
Figure 10:
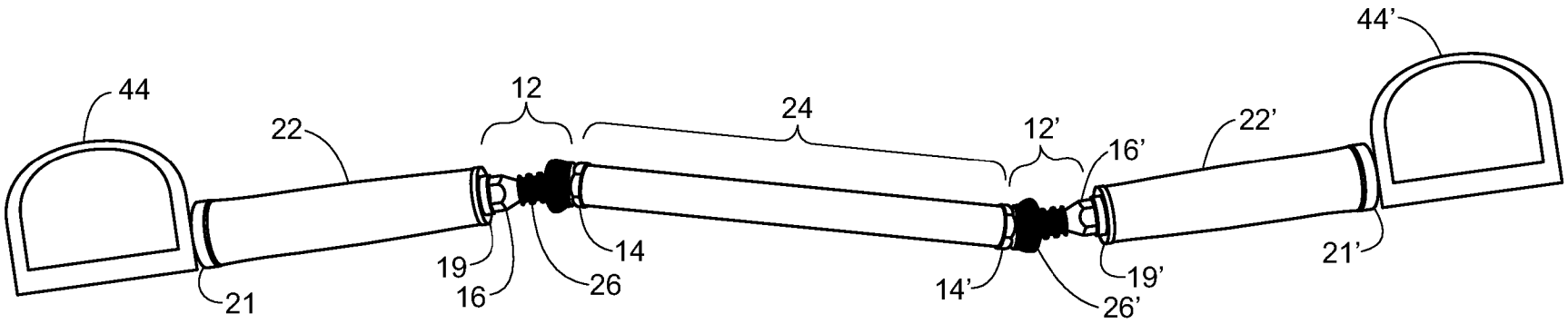
FIG. 10 shows the ergonomic rotational muscle stretching device having a stirrup attached to the ends of the handles of the device for placing a user's feet in the stirrups so that the device can be used for exercising lower extremities of the body.

As shown in FIG. 9, the method further comprises attaching a first stirrup 44 and a second stirrup 44', each stirrup 44, 44' having a bolt attached thereon (not shown) adjacent to the second ends 21, 21' of the first handle 22 and second handle 22', respectively, to allow an individual to place their feet (not shown) in the stirrups 44, 44', so that the individual can exercise the lower extremities of the body, i.e., feet, legs, thighs and hips. The first and second stirrups 44, 44' are attached to the first and second handles 22, 22' by threadably inserting their respective bolts into the openings of the second ends 21, 21' of the first and second handles 22, 22'; having an individual place one foot in the first stirrup and the other foot in the second stirrup; and stretching one or more muscles by pushing and/or pulling on the stirrups which causes the handles to rotate on the x, y and z axes in tandem with rotation of joints associated with the one or more muscles during the stretching of the one or more muscles so that the joints are not negatively stressed and/or strained.

In operation, when exercising muscles of both arms together or muscles of both legs together, the inventive device allows for a symmetrical and large degree of motion of corresponding joints of the muscles, which symmetry and degree of joint motion is almost impossible to achieve when exercising corresponding muscles with prior art arm and leg exercise devices.

In accordance with the invention, the one or more muscle groups of the individual include, without limitation, muscles causing flexion and extension of parts of the body selected from the group consisting of hands, arms, shoulders, neck, chest, back, torso, hips, thighs, legs and feet.

In accordance with the invention, associated joints of the one or more muscle groups include, without limitation, wrist, elbow, rotator cuff, neck, hip, knee and ankle joints.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

What is claimed is:

1. An ergonomic rotational muscle stretching device for stretching, strengthening and increasing flexibility of one or more muscles groups of a healthy individual and a patient recovering from muscle injury or surgery as well as facilitating muscle recovery in the patient, without placing negative stress and/or strain on associated joints of the one or more muscle groups, comprising:

a center rod having a first end, a second end, and an interior opening therein, said interior opening having threads therein;

a first handle and a second handle, each of said first and second handles having a first end and a second end, each of said first and second ends having an opening therein, said openings having threads therein; and a first linear bearing and a second linear bearing, each of said first and second linear bearings having a socket end and a ball end, said socket end having a first side and a second side, said ball end having a first side and a second side, said first side of the socket end having an opening therein which accepts the second side of the ball end inserted therein, said second side of the socket end comprised of a socket end bolt, said first side of the ball end comprised of a ball end bolt, wherein the first socket end bolt threadably inserts into the interior opening of the first end of the center rod and the second socket end bolt threadably inserts into the interior opening of second end of the center rod, wherein the first ball end bolt threadably inserts into the interior opening of the first end of the first handle and the second ball end bolt threadably inserts into the interior opening of the first end of the second handle, wherein the first and second linear bearings have a flexible covering which protects the linear bearings, said flexible covering made from materials selected from rubber and plastics, wherein the first and second linear bearings allow the first and second handles to rotate 10 degrees to 75 degrees on an x and y axis, and rotate 360 degrees on a z axis, wherein the first and second linear bearings allow a user to achieve a symmetrical and full range of motion of joints corresponding to muscles being exercised.

2. The device of claim 1, wherein the first and second linear bearings allow the first and second handles to rotate 30 degrees on an x and y axis, and rotate 360 degrees on a z axis.

3. The device of claim 1, wherein the center rod is cylindrical and has a length of 5 inches to 30 inches, an outer diameter of 0.25 inches to 3.0 inches, and an inner diameter of 0.15 inches to 2.0 inches, wherein the first handle and the second handle have a length of 3.0 inches to 6.0 inches, an outer diameter of 0.5 inches to 3.0 inches and an inner diameter of 0.25 inches to 1.5 inches.

4. The device of claim 3, wherein the center rod is cylindrical and has a length of 25 inches, an outer diameter of 0.5 inches, and an inner diameter of 0.3 inches, wherein the first handle and the second handle have a length of 4.5 inches, an outer diameter of 1.0 inch, and an inner diameter of 0.5 inches.

5. The device of claim 1, wherein the center rod is an adjustable length center rod comprised of a first rod section, a second rod section and a locking ring, said first rod section having a larger inner diameter than an outer diameter of the second rod section so that that the second rod section inserts telescopically into an interior opening of the first rod section, wherein the center rod has an adjustable length of 5.0 inches to 30 inches, which length is locked in place by tightening the locking ring, wherein the inner diameter of the first rod section is 0.25 inches to 2.0 inches, and the outer diameter of the second rod section is 0.20 inches to 1.75 inches.

6. The device of claim 1, wherein the center rod is manufactured from materials selected from group consisting of aluminum, anodized aluminum, steel, chrome, plastic, rubber, conduit, graphite, carbon fiber, fiberglass, brass, copper and wood, wherein the first and second linear bearings are manufactured from materials selected from the group consisting of steel, brass and plastics, wherein the first handle and the second handle is manufactured from materials selected from the group consisting of rubber, leather, cork, cord and plastics.

7. The device of claim 1, further comprising one or more weights placed onto the center rod section, said one or more weights comprising a hinged weight which locks onto the center rod via a clasp, or a bar weight having a bolt which threadably inserts into a threaded hole in the center rod section, said one or more weights each weighing 0.5 pounds to 5.0 pounds.

8. The device of claim 1, further comprising a first stirrup attached to the first handle and a second stirrup attached to the second handle, said first and second stirrups each attached via bolts which insert into the openings of the second ends of the first and second handles.

9. The device of claim 1, wherein the one or more muscle groups of the individual comprise muscles causing flexion and extension of parts of the body selected from the group consisting of hands, arms, shoulders, neck, chest, back, torso, hips, thighs, legs and feet, wherein the associated joints of the one or more muscle groups comprise joints selected from the group consisting of wrist, elbow, shoulder rotator cuff, neck, hip, knee and ankle joints.

10. A method of stretching, strengthening and increasing flexibility of one or more muscles groups of a healthy individual and a patient recovering from muscle injury or surgery as well as facilitating muscle recovery in the patient, comprising:

having an individual exercise with an ergonomic rotational muscle stretching device in order to stretch, strengthen and increase flexibility to one or more muscle groups, wherein the device allows a user to achieve a symmetrical and full range of motion of joints corresponding to muscles being exercised, wherein the device places minimal negative stress and/or strain on joints associated with the one or more muscles, said ergonomic rotational muscle stretching device comprising:

a center rod having a first end, a second end, and an interior opening therein, said interior opening having threads therein;

a first handle and a second handle, each of said first and second handles having a first end and a second end, each of said first and second handles having an opening therein, said openings having threads therein;

a first linear bearing and a second linear bearing, each of said first and second linear bearings having a socket end and a ball end, said socket end having a first side and a second side, said ball end having a first side and a second side, said first side of the socket end having an opening therein which accepts the second side of the ball end inserted therein, said second side of the socket end comprised of a socket end bolt, said first side of the ball end comprised of a ball end bolt, wherein the first socket end bolt threadably inserts into the interior opening of the first end of the center rod and the second socket end bolt threadably inserts into the interior opening of second end of the center rod, wherein the first ball end bolt threadably inserts into the interior opening of the first end of the first handle and the second ball end bolt threadably inserts into the interior opening of the first end of the second handle, wherein the first and second linear bearings have a flexible covering which protects the linear bearings, said flexible covering made from materials selected from rubber and plastics, wherein the first and second linear bearings allow the first and second handles to rotate 10 degrees to 75 degrees on an x and y axis, and rotate 360 degrees on a z axis, and wherein angle of rotational movement of the handles is substantially identical to angle of rotational movement of the joints being exercised.

11. The method of claim 10, wherein the first and second linear bearings allow the first and second handles to rotate 30 degrees on an x and y axis, and rotate 360 degrees on a z axis.

12. The method of claim 10, further comprising:

having an individual grip the first handle with one hand and grip the second handle with another hand; and stretching one or more muscle groups by pushing and/or pulling on the handles, said handles rotating on the x, y and z axes in tandem with rotation of joints associated with the one or more muscle groups during the stretching of the one or more muscle groups so that the joints are minimally stressed and/or strained.

13. The method of claim 10, further comprising:

attaching a first stirrup having a bolt attached thereon onto the second end of the first handle, said first stirrup attached by threadably inserting the bolt into the opening of the second end of the first handle;

attaching a second stirrup having a bolt attached thereon onto the second end of the second handle, said second stirrup attached by threadably inserting the bolt into the opening of the second end of the first handle;

having an individual place one foot in the first stirrup and another foot in the second stirrup; and stretching one or more muscle groups by pushing and/or pulling on the handles, said handles rotating on the x, y and z axes in tandem with rotation of joints associated with the one or more muscle groups during the stretching of the one or more muscle groups so that the joints are minimally stressed and/or strained.

14. The method of claim 10, wherein the one or more muscle groups comprise muscles selected from the group consisting of hands, arms, shoulders, neck, chest, back, torso, hips, thighs, legs and feet, wherein the associated joints comprise joints selected from the group consisting of wrists, elbows, shoulder rotator cuffs, neck, hips, knees and ankles.

15. The method of claim 10, wherein the center rod is cylindrical and has a length of 5 inches to 30 inches, an outer diameter of 0.25 inches to 3.0 inches, and an inner diameter of 0.15 inches to 2.0 inches, wherein the first handle and the second handle have a length of 3.0 inches to 6.0 inches, an outer diameter of 0.5 inches to 3.0 inches and an inner diameter of 0.25 inches to 1.5 inches.

16. The method of claim 15, wherein the center rod is cylindrical and has a length of 25 inches, an outer diameter of 0.5 inches, and an inner diameter of 0.3 inches, wherein the first handle and the second handle have a length of 4.5 inches, an outer diameter of 1.0 inch, and an inner diameter of 0.5 inches.

17. The method of claim 10, further comprising a flexible covering surrounding the first and second linear bearings for protection, said flexible covering made from materials selected from rubber and plastics.

18. The method of claim 10, wherein the center rod is an adjustable length center rod comprised of a first rod section, a second rod section and a locking ring, said first rod section having a larger inner diameter than an outer diameter of the second rod section so that that the second rod section inserts telescopically into an interior opening of the first rod section, wherein the center rod has an adjustable length of 5.0 inches to 30 inches, which length is locked in place by tightening the locking ring, wherein the inner diameter of the first rod section is 0.25 inches to 2.0 inches, and the outer diameter of the second rod section is 0.20 inches to 1.75 inches.

19. The method of claim 10, further comprising one or more weights placed onto the center rod section, said one or more weights comprising a hinged weight which locks onto the center rod via a clasp, or a bar weight having a bolt which threadably inserts into a threaded hole in the center rod section, said one or more weights each weighing 0.5 pounds to 5.0 pounds.

20. The method of claim 10, wherein the center rod is manufactured from materials selected from group consisting of aluminum, anodized aluminum, steel, chrome, plastic, rubber, conduit, graphite, carbon fiber, fiberglass, brass, copper and wood, wherein the first and second linear bearings are manufactured from materials selected from the group consisting of steel, brass and plastics, wherein the first handle and the second handle is manufactured from materials selected from the group consisting of rubber, leather, cork, cord and plastics.

* * * * *